US008522467B1

(12) United States Patent
Christensen et al.

(10) Patent No.: US 8,522,467 B1
(45) Date of Patent: Sep. 3, 2013

(54) COMPOSITE HAND GUARD WITH INTEGRAL RAIL

(76) Inventors: Jason Christensen, Gunnison, UT (US); Roland J. Christensen, Gunnison, UT (US)

( * ) Notice: Subject to any disclaimer, the term of this patent is extended or adjusted under 35 U.S.C. 154(b) by 114 days.

(21) Appl. No.: 13/226,231

(22) Filed: Sep. 6, 2011

Related U.S. Application Data

(60) Provisional application No. 61/380,644, filed on Sep. 7, 2010.

(51) Int. Cl.
*F41C 23/00* (2006.01)

(52) U.S. Cl.
USPC ..... 42/71.01; 42/72

(58) Field of Classification Search
USPC ..... 42/71.01, 72
See application file for complete search history.

(56) References Cited

U.S. PATENT DOCUMENTS

| | | | | |
|---|---|---|---|---|
| 3,090,150 | A * | 5/1963 | Stoner | 42/71.01 |
| 6,490,822 | B1 * | 12/2002 | Swan | 42/71.01 |
| 7,430,829 | B2 | 10/2008 | Murello | |
| 7,584,567 | B1 * | 9/2009 | DeSomma et al. | 42/71.01 |
| 7,685,758 | B2 | 3/2010 | Romer | |
| 7,716,865 | B2 | 5/2010 | Daniel et al. | |
| 7,971,379 | B2 * | 7/2011 | Robinson et al. | 42/7 |
| 8,276,303 | B2 * | 10/2012 | Kapusta et al. | 42/71.01 |
| 2005/0262752 | A1 * | 12/2005 | Robinson et al. | 42/71.01 |
| 2006/0064913 | A1 * | 3/2006 | Gablowski et al. | 42/72 |
| 2007/0006509 | A1 * | 1/2007 | DeSomma et al. | 42/72 |
| 2007/0163163 | A1 * | 7/2007 | Munst | 42/85 |
| 2008/0092422 | A1 * | 4/2008 | Daniel et al. | 42/90 |
| 2010/0319231 | A1 * | 12/2010 | Stone et al. | 42/71.01 |
| 2012/0036756 | A1 * | 2/2012 | Brown | 42/71.01 |

OTHER PUBLICATIONS

Composite Resources; Composite AR-15 Handgaurd for Superior Heat Dissipation—Composite Resources; 2 pages; as accessed Sep. 6, 2011.

http://www.brownells.com/userdocs/skus/1_100003845_1.jpg; as accessed Aug. 31, 2010; 1 page.

Remington 870 Picatinny Rail Handguard Rem .870 Handguard Rail—Fab Defense; as accessed Sep. 6, 2011; 1 page.

TAPCO, Inc. http//:www.ar15pro.com/item/72200_Tapco_inc_grips_pads_stocks_ . . . ; as accessed Aug. 25, 2010; 1 page.

Photo; http://www.ar15outfitters.com/assets/images/(aim-mt021-)12.jpg; as accessed Aug. 31, 2010; 1 page.

Photo; http://www.gunsholstersandgear.com/wp-content/uploads/2010/05/tapco_ar_handguard_0 . . . ; as accessed Aug. 31, 2010; 1 page.

Photo; http://images1.tacticalstor.com/750-500-ffffff/opplanet-osprey-m4handguard-m-osp-qr1; as accessed Aug. 31, 2010; 1page.

* cited by examiner

*Primary Examiner* — Samir Abdosh
(74) *Attorney, Agent, or Firm* — Thorpe North & Western LLP

(57) ABSTRACT

An integral hand guard and accessory rail has an elongated shell with a shell wall adapted to be spaced-apart from and circumscribing a barrel of a firearm. The shell has a portion adapted to be griped by a user and defining a hand guard. The shell wall has another portion protruding radially away from the barrel defining an elongated rail, the rail having a cross-sectional shape orthogonal to the axis with a narrower neck a wider head coupled to the shell by the neck.

19 Claims, 4 Drawing Sheets

COMPOSITE HAND GUARD WITH INTEGRAL RAIL

PRIORITY CLAIM(S)

Priority of U.S. Provisional Patent Application Ser. No. 61/380,644, filed on Sep. 7, 2010, is claimed; and is herein incorporated by reference in its entirety.

BACKGROUND

1. Field of the Invention

The present invention relates generally to hand guards and accessory rails for firearms.

2. Related Art

Various accessories can be mounted to a firearm, such as an M-16, AR-15, AR-10 or M4 type rifle, using a rail, such as a Picatinny rail system. For example, see U.S. Pat. No. 7,716,865; 7,430,829; 7,685,758 or 2008-0092422. The rail is usually mounted to some portion of the firearm, such as an upper receiver.

SUMMARY OF THE INVENTION

It has been recognized that it would be advantageous to develop a hand guard with an integrated rail that is strong, light-weight and stiff.

The invention provides a firearm accessory device in combination with a firearm having a barrel. An elongated tube extends axially along at least a portion of a length of the barrel and extends circumferentially around the barrel. A hand guard is formed by the tube around a bottom and lateral sides of the tube at a proximal end of the tube. An elongated rail is formed by the tube along a top of the tube, a bottom of the tube at a distal end of the tube, a lateral side of the tube at the distal end of the tube, or combinations thereof. The elongated rail is aligned with the shell wall and the barrel, and has a cross-sectional shape orthogonal to the shell wall and the barrel with a narrower neck and a wider head, with the enlarged head being segmented along a length thereof. A monolithic shell wall forms the tube and extends circumferentially around the barrel, and forms the hand guard and the elongated rail, with the shell wall substantially surrounding the barrel in a spaced-apart relationship. An elongated hollow is defined between the barrel and the shell wall, and extends continuously and uninterrupted radially between the barrel and the shell wall, and into the narrower neck of the rail.

In addition, the invention provides a firearm accessory device in combination with a firearm having a barrel. A hand guard is disposed around at least a portion of the barrel and has an elongate shell with an axis aligned with an axis of the barrel. The shell has a shell wall spaced-apart from and circumscribing the barrel. An elongated rail protrudes from the shell and is defined by the shell wall. The rail has an axis aligned with an axis of the shell and the barrel. The rail has a cross-sectional shape orthogonal to the axis with a narrower neck a wider head coupled to the shell by the neck. An elongate hollow is defined by the shell wall with the hollow extending longitudinally between the barrel and the shell wall, and radially between the barrel and the shell wall and into the neck of the rail.

Furthermore, the invention provides a firearm accessory device with an elongated shell having a shell wall adapted to be spaced-apart from and circumscribing a barrel of a firearm and having a longitudinal axis aligned with a longitudinal axis of the barrel. The shell has a portion adapted to be griped by a user and defining a hand guard. The shell wall has another portion protruding radially away from the barrel defining an elongated rail. The rail has an axis aligned with an axis of the barrel. The rail has a cross-sectional shape orthogonal to the axis with a narrower neck a wider head coupled to the shell by the neck.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
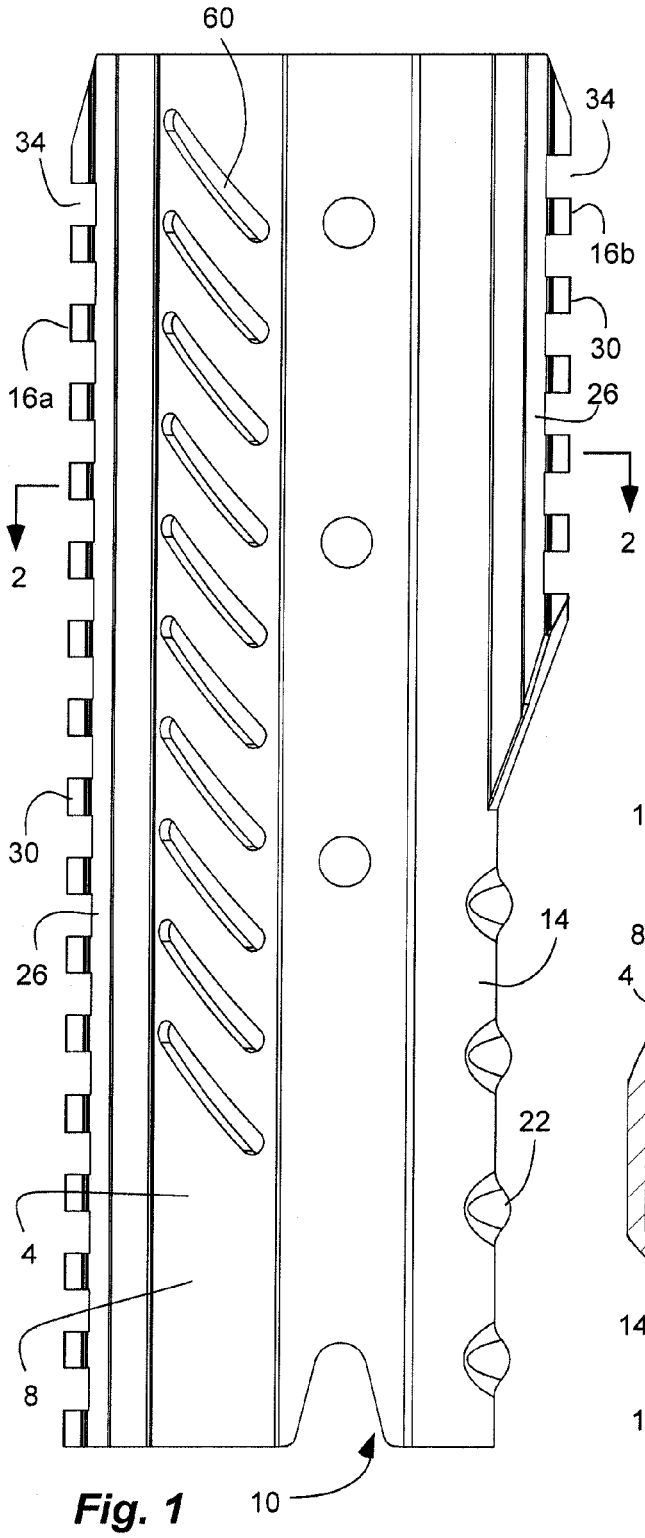
FIG. 1 is a side view of an integrated hand guard and accessory rail for a firearm in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in the FIGS. 1-8, an integrated hand guard and accessory rail device, or firearm accessory, indicated generally at 10, in an example implementation in accordance with the invention is shown that can be disposed over a barrel of a firearm 12 (FIG. 6), and/or can be or can form part of an upper receiver of a firearm. The firearm can be an M-16, AR-15, AR-10 or M4 type rifle, or the like. The integrated hand guard and accessory rail 10, or firearm accessory, has a hand guard 14 or hand guard portion, and that has at least one integrated accessory rail 16*a* or 16*b*, such as a Picatinny rail or the like. The accessory rail 16 can receive one or more accessories, represented by 18*a* and 18*b* (FIGS. 6-8), detachably coupled to the rail 16 and thus the firearm 12, including, for example, a hand grip with an axis transverse to the longitudinal axis of the barrel; a light source; a laser; a scope; a tactical scope; a sight; a night vision system; a bipod; a stand; a rail cover; a carrier or mount; a stock; a retractable stock; a foregrip; a sling; a sling mount or adaptor; a magazine pouch; a bayonet; a bayonet mount; a clamp or fixture or combinations thereof. Integrating the hand guard and rail can provide a stiff rail and hand guard to resist relative movement of the accessory, such as a site, to help maintain accuracy of the firearm. The integrated hand guard and accessory rail 10, or firearm accessory, includes an elongated tube 4 extending axially along at least a portion of a length of a the barrel 20 (FIGS. 6-8), and extending circumferentially around the barrel. The tube substantially surrounds the barrel in a spaced-apart relationship, and with an annular air space therebetween. The tube 4 includes a monolithic shell wall 8 forming the tube, the hand guard 14 and the accessory rail 16*a* and/or 16*b*. Thus, the shell wall 8 extends circumferentially around the barrel 20 and surrounds the barrel in a spaced-apart relationship, or is spaced-apart therefrom.

The hand guard 14 is disposed around at least a portion of the barrel 20 (FIGS. 6-8) to allow the user to grasp the hand guard at the barrel, without touching the barrel, and thus protecting the user's hand from the heat of the barrel (which can reach approximately 500° F.). The hand guard 14 can have a longitudinal axis parallel with a longitudinal axis of the barrel of the firearm. The hand guard is formed by the tube around a bottom and lateral sides of the tube at a proximal end of the tube or device. The hand guard can have a bottom with a convex curvature that is substantially round or circular cross-section. In addition, the hand guard can include lateral sides extending from the bottom that are substantially straight and vertical. The top of the hand guard, tube or shell wall can include at least a portion with a convex curvature that is round or circular cross-section, with a radius of the bottom being greater than the top to create a broader bottom surface to be grasped by a user. Straight vertical lateral sections can interconnect the circular top and bottom of the hand guard at lateral sides thereof. A plurality of longitudinally spaced-apart ridges 22 is disposed on the outer surface of the bottom of the hand guard 22 at a proximal end or rear end or portion of the hand guard or device. The ridges are oriented transverse to the longitudinal axis and spaced-apart to receive a user's fingers therebetween to facilitate grasping of the firearm. Thus, the bottom of the hand guard 14 can lay in palm and/or fingers of the user's hand during use, and separates the user's hand from the barrel 20.

Figure 6:
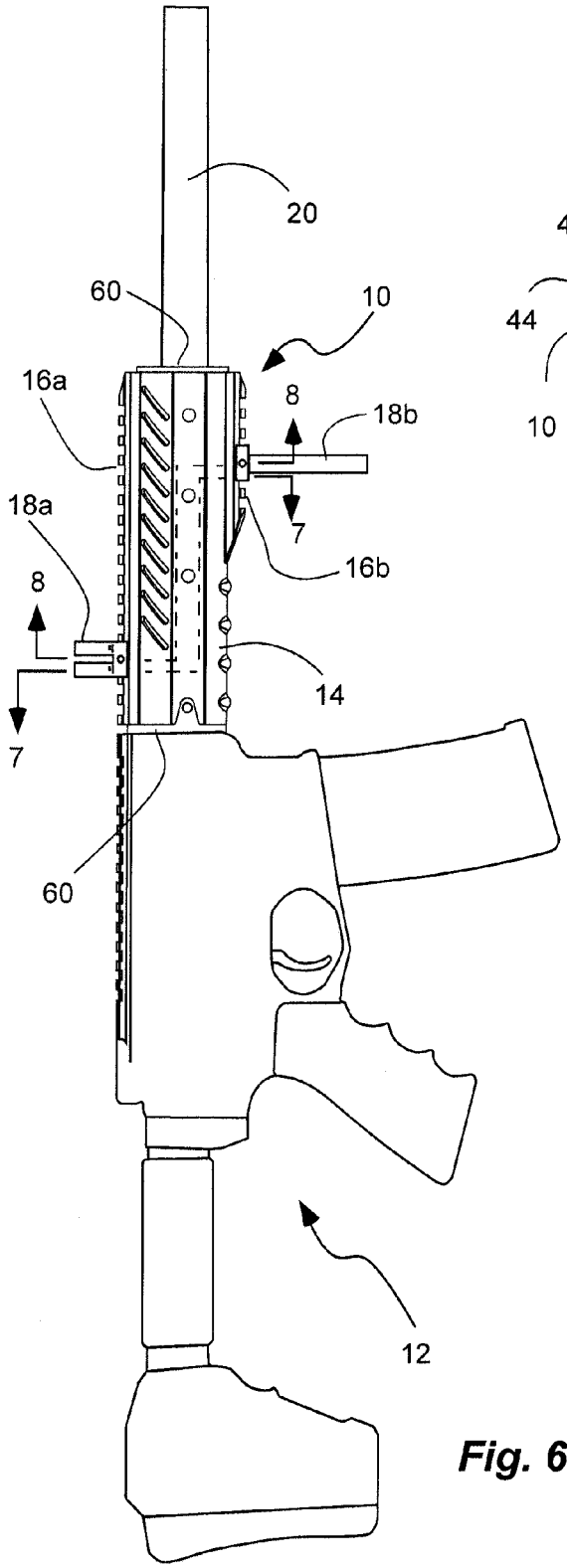
FIG. 6 is a side view of the firearm with the hand guard and accessory rail of FIG. 1.
Figure 7:
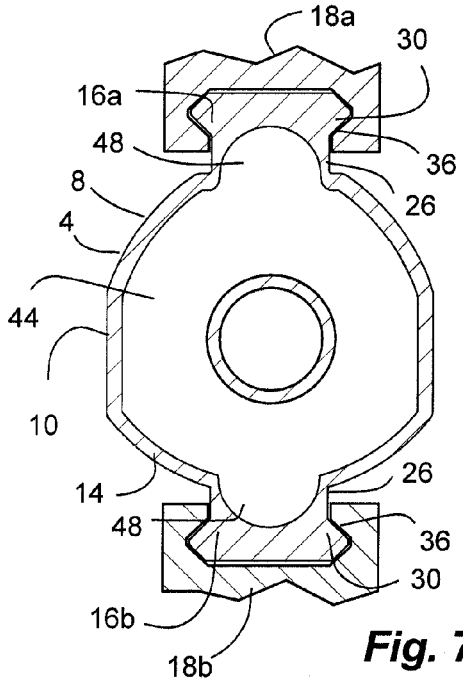
FIG. 7 is a cross-sectional end view of the hand guard and accessory rail of FIG. 1, taken along line 7 of FIG. 6.
Figure 8:
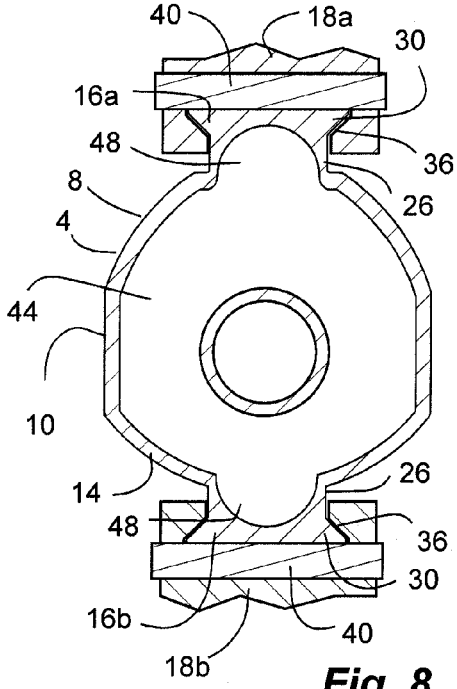
FIG. 8 is a cross-sectional end view of the hand guard and accessory rail of FIG. 1, taken along line 8 of FIG. 6.
Figure 9:
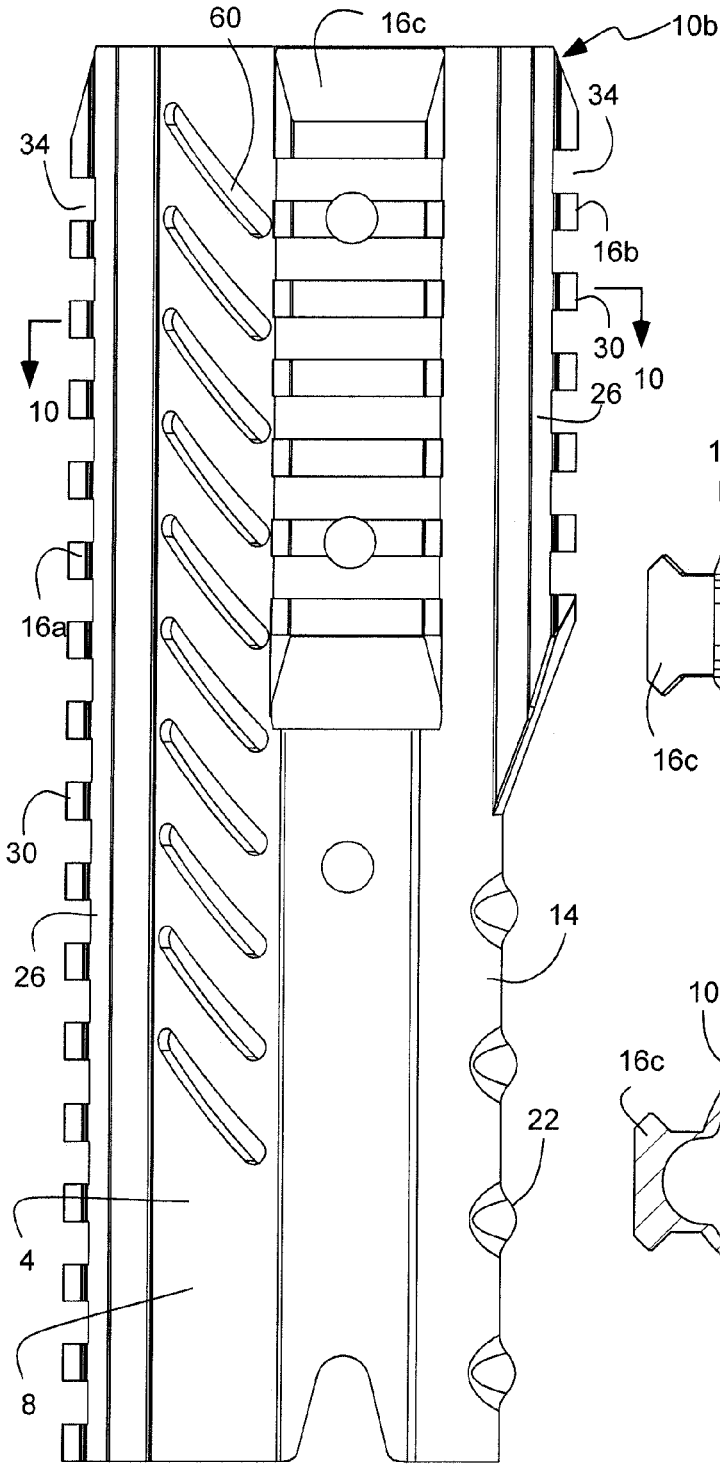
FIG. 9 is a side view of another integrated hand guard and accessory rail for a firearm in accordance with another embodiment of the present invention.
Figure 11:
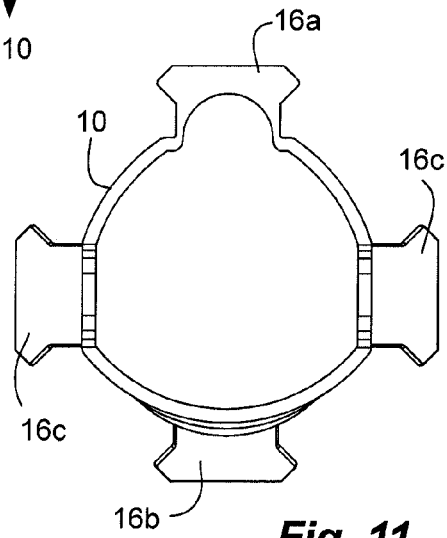
FIG. 11 is an end view of the hand guard and accessory rail of FIG. 9.
Figure 10:
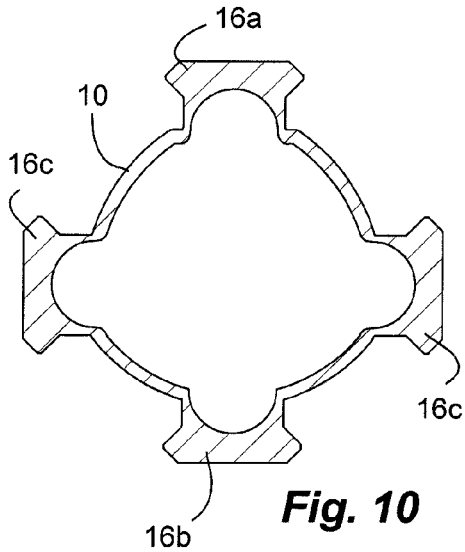
FIG. 10 is a cross-sectional end view of the hand guard and accessory rail of FIG. 9, taken along line 10 of FIG. 9.

The accessory rail can include an upper rail 16*a* disposed on the top of the hand guard or device, and a lower rail 14*b* disposed on a bottom of the hand guard. The upper rail 16*a* can be formed along the top of the tube, while the bottom rail 16*b* can be formed along a bottom of the tube at a distal end of the tube. (One or more lateral rails 16*c* can be formed along one or more lateral sides of the tube and at the distal end of the tube, as shown in FIGS. 9-11.) The rails can be aligned with the tube, shell wall, barrel and longitudinal axis. The upper and lower rails 16*a* and 16*b* can be integrally formed and monolithic with the hand guard 14 and the device can have a monolithic shell wall that is continuous, uninterrupted and seamless (except for vent holes and/or mounting holes) around the circumference thereof to provide stiffness and accuracy. In addition, rails can be disposed on the side of the hand guard, such as by attachment with mechanical fasteners to holes in the sides of the handguard. The lower rail 14*b* can be disposed on a distal or forward portion of the hand guard, tube or device. The hand guard 14 can be formed along a first longitudinal portion or proximal end, and the bottom rail 16*b* can be formed along a second longitudinal portion or distal end. The upper rail 16*a* can extend the length of the hand guard or device. In addition, the upper rail 16*a* can align with an accessory rail of an upper receiver of the firearm, as shown in FIG. 6. The rails 16*a* and 16*b* can have a narrower neck 26 extending from the hand guard or tube, with an enlarged head 30 thereon so that the head is spaced from the hand guard or tube and connected thereto by the neck. The rails have a longitudinal axis aligned with the axis of the barrel. The head is segmented along a length thereof to form a series of spaced-apart grooves 34 transverse or orthogonal to the longitudinal axis. The head 30 and neck 26 of the rails are received within a groove 36 of the accessory 18*a* and/or 18*b*, while a locking pin 40 of the accessory is received in one of the grooves 34 to resist movement of the accessory along the rail, as shown in FIGS. 7 and 8.

The hand guard 14 and accessory rail 16*a* and/or 16*b* are separate and distinct structures with different shapes, sizes, and/or profiles. The hand guard is shaped with broad curvatures and smooth surfaces to be grasped by a user, while the accessory rail is shaped and sized to releasably and lockably receive an accessory. The hand guard 14 can be free of the accessory rail 16*a* and 16*b*, or without the accessory rail interfering with the grip formed by the hand guard.

Figure 3:
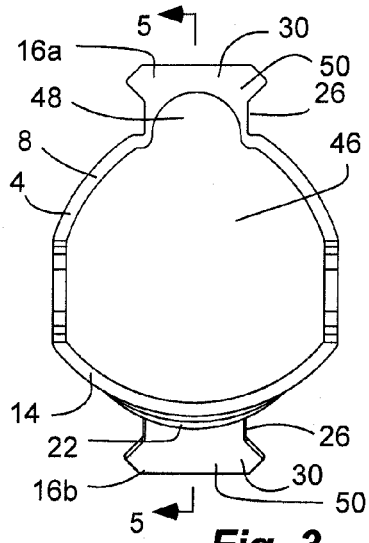
FIG. 3 is an end view of the hand guard and accessory rail of FIG. 1.
Figure 2:
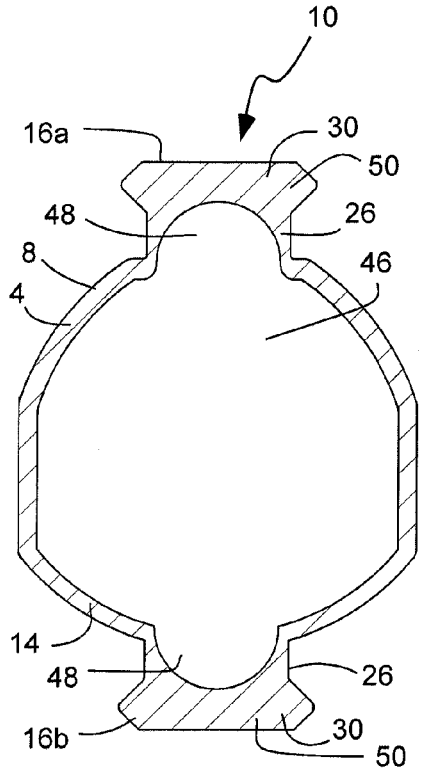
FIG. 2 is a cross-sectional end view of the hand guard and accessory rail of FIG. 1, taken along line 2 of FIG. 1.
Figure 4:
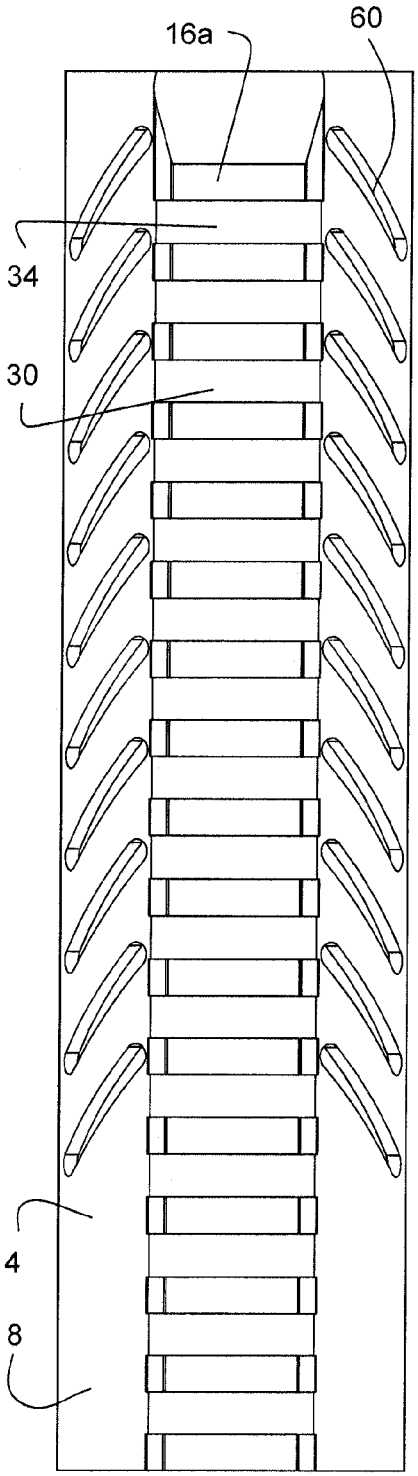
FIG. 4 is a top view of the hand guard and accessory rail of FIG. 1.
Figure 5:
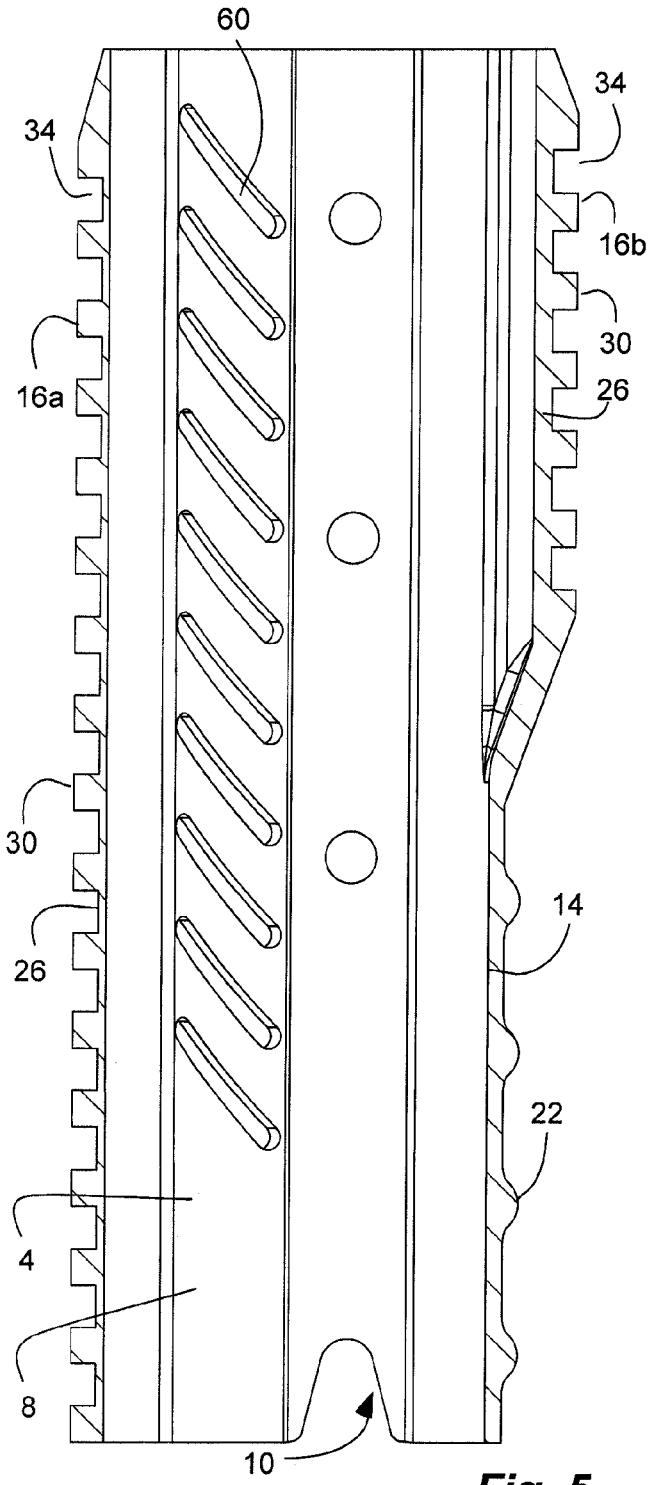
FIG. 5 is a cross-sectional side view of the hand guard and accessory rail of FIG. 1, taken along line 5 of FIG. 3.

The hand guard 14 and/or rail 16*a* and 16*b* are formed by the elongate tube 4 with a longitudinal axis aligned with the axis of the barrel 20. The tube 4 has shell wall 8 spaced-apart from and circumscribing the barrel 20. The shell wall 8 defines and forms the hand guard 14 and rail 16*a* and 16*b*. The rail can protrude from the tube or profile of the tube. The tube 4 and shell wall 8 define an elongate annular hollow 44 (FIGS. 7 and 8) extending longitudinally between the barrel 20 and shell wall 8, and radially between the barrel 20 and shell wall 8. Without the barrel, the tube and shell wall can define a central hollow 46 (FIGS. 2 and 3). The hollow 44 or 46 extends into the neck 26 of the rail. Thus, the neck 26 of the rail can be hollow. The hollow neck 26 can form a channel or channel hollow 48. Thus, the elongate hollow comprises a main central hollow 44 or 46 and a channel 48 connected thereto and defined by the rail. The hollow extends from the barrel continuously and uninterrupted therefrom through the annular hollow 44 and into the channel 48. The shell wall 8 circumscribes the barrel forming the monolithic, continuous, uninterrupted and seamless wall forming both the hand guard 14 and the rail 16*a* and 16*b* in a single revolution around the barrel. The hand guard and rail can be a monolithic structure with the shell wall being continuous and uninterrupted and seamless as it circumscribes the axis. The channel walls can be substantially orthogonal to the curved walls of the top and bottom. The bottom of the channel can be concave or arcuate. Thus, the wall circumscribing the barrel can have a substantially constant thickness around substantially the entire barrel forming the hand guard (or top and bottom curved portions and lateral portions), without increases in thickness to accommodate fasteners. The rail or head can be thicker than the hand guard. The cross-sectional shape of the rail interrupts the curvature of the top and bottom of the tube or shell wall and adds elongated hollow lobes to the annular hollow of the hand guard.

The shell wall can be formed by a composite material with a fiber, such as carbon, in a resin matrix. The shell wall can have a non-uniform thickness extending circumferentially or radially at the rail. The fiber can include various layers of woven mat. For example, a majority of the wall can be formed by eight layers, including inner and outermost layers with fibers oriented at 0 and 90 degrees with respect to the longitudinal axis (or longitudinally and laterally or circumferentially); four intermediate layers of fiber oriented at 45 degrees with respect to the longitudinal axis (or helically in both directions); and two interior layers of unidirectional fibers oriented longitudinally or at 0 degrees. In addition, additional unidirectional, longitudinal fibers, indicated at 50, can be disposed in the rail or head of the rail. The additional unidirectional, longitudinal fibers in the rail can help maintain the stiffness of the rail and hand guard, and can resist relative movement of accessories mounted to the rail. Thus, the fiber density of the wall increases at the rails with respect to the hand guard. The rail can have between 50-80% more unidirectional fibers in one aspect, or 60-70% more unidirectional fibers in another aspect. Such a lay-up can provide a good coefficient of thermal expansion (CTE).

The hand guard can be provided with end caps 60 (FIG. 6) bonded and/or mechanically fastened to the open ends of the tube to couple the tube to the barrel or the upper receiver. The end caps can also be formed of composite material, or can be plastic or metal, such as aluminum.

The hand guard described above provides a combined rail and hand guard that is strong, light-weight and stiff.

Referring to FIGS. 9-11, another integrated hand guard and accessory rail device 10*b*, or firearm accessory, is shown that is similar to that described above, and which description is herein incorporated by reference. The device 10*b* can have one or more side rails 16*c* integrally formed by the shell wall with the tube as described above.

It will be appreciated that the integrated hand guard and accessory rail devices, or firearm accessories, described above can be provides with a single rail, such as only an upper, bottom, or side rail.

The tube or shell wall can have one or more vent holes or apertures 60 extending therethrough. The vent holes or apertures 60 can be located in the lateral side walls. Additional apertures can be formed in the tube or shell wall to accommodate fasteners. For example, separate side rails can be coupled to the side walls of the tube or shell using fasteners.

A method for making the integrated hand guard and accessory rail, or firearm accessory, for a firearm as described above includes obtaining or using an internal mandrel and an external mold. The external mold can have a cavity shaped as an exterior of a hand guard with at least one rail. The external mold can have at least two halves to open and close about the internal mandrel. The internal mandrel can be disposable within the cavity. Thus, an annular cavity is defined between the internal mandrel and external mold to receive fiber and resin. Fiber, such as woven mat fiber and/or unidirectional fiber, is layed-up on the internal mandrel, and inside the cavity of the external mold. The fiber can be pre-preg fiber pre-impregnated with resin. Additional longitudinal fibers can be layed-up in the cavity defining the at least one rail. For example, a woven mat fiber can be layed-up on the internal mandrel and oriented at 0 and 90 degrees. Similarly, a woven mate fiver can be layed-up in the cavity of the external mold and oriented at 0 and 90 degrees. One or more additional woven mat layers can be layed-up on the internal mandrel and oriented at 45 degrees. Similarly, one or more additional woven mat layers can be layed-up in the cavity of the external mold and oriented at 45 degrees. One or more unidirectional mats can be layed-up on the mandrel and/or in the cavity and oriented at 0 degrees. The external mold is closed about the internal mandrel with the fiber therebetween. The mold can be sealed about the internal mandrel. Resin can be injected into the cavity between the internal mandrel and the external mold under pressure. The mold can be opened and the fiber with the resin removed from the external mold and internal mandrel. The resin can cure in and/or out of the mold. Grooves can be cut in a head of the at least one rail, with the grooves oriented transverse to a longitudinal axis of the rail. Other holes for venting or mounting can be cut unto the hand guard.

As used herein, cross-sections are taken orthogonal or perpendicularly to the axis.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A firearm accessory device in combination with a firearm having a barrel, the device comprising:

a) an elongated tube extending axially along at least a portion of a length of the barrel and extending circumferentially around the barrel;

b) a hand guard formed by the tube around a bottom and lateral sides of the tube at a proximal end of the tube;

c) an elongated rail formed by the tube along a top of the tube, a bottom of the tube at a distal end of the tube, a lateral side of the tube at the distal end of the tube, or combinations thereof;

d) a monolithic shell wall forming the tube and extending circumferentially around the barrel and forming the hand guard and the elongated rail, the shell wall substantially surrounding the barrel in a spaced-apart relationship;

e) the elongated rail being aligned with the shell wall and the barrel, and having a cross-sectional shape orthogonal to the shell wall and the barrel with a narrower neck and a wider head, and the enlarged head being segmented along a length thereof;

f) an elongated hollow defined between the barrel and the shell wall, and extending continuously and uninterrupted radially between the barrel and the shell wall, and into the narrower neck of the rail;

g) the shell wall being formed by a composite material with a fiber in a resin matrix; and h) the rail including additional longitudinal fibers with respect to the hand guard.

2. A device in accordance with claim 1, wherein the hand guard has a convex curvature free of the rail.

3. A device in accordance with claim 1, wherein the elongate hollow comprises an annular hollow and a channel connected thereto defined by the rail.

4. A device in accordance with claim 1, wherein the shell wall has a non-uniform thickness extending circumferentially.

5. A device in accordance with claim 1, further in combination with an accessory detachably coupled to the rail, the accessory being selected from the group consisting of: a hand grip with an axis transverse to the longitudinal axis of the barrel; a light source; a laser; a scope; a tactical scope; a sight; a night vision system; a bipod; a stand; a rail cover; a carrier or mount; a stock; a retractable stock; a foregrip; a sling; a sling mount or adaptor; a magazine pouch; a bayonet; a bayonet mount; a clamp or fixture or combinations thereof.

6. A device in accordance with claim 1, wherein the shell wall is continuous and uninterrupted and seamless as the shell wall circumscribes the barrel.

7. A device in accordance with claim 1, wherein a fiber density at the rail is 60-70% greater than at the hand guard.

8. A device in accordance with claim 1, wherein the hand guard and the rail are integrally formed together at the same time as the shell wall.

9. A firearm accessory device in combination with a firearm having a barrel, the device comprising:

a) a hand guard disposed around at least a portion of the barrel and having an elongate shell with an axis aligned with an axis of the barrel, the shell having a shell wall spaced-apart from and circumscribing the barrel;

b) an elongated rail protruding from the shell and defined by the shell wall, the rail having an axis aligned with an axis of the shell and the barrel, the rail having a cross-sectional shape orthogonal to the axis with a narrower neck and a wider head coupled to the shell by the neck;

c) an elongate hollow defined by the shell wall with the hollow extending longitudinally between the barrel and the shell wall, and radially between the barrel and the shell wall and into the neck of the rail;

d) the shell wall being formed by a composite material with a fiber in a resin matrix; and e) the rail including additional longitudinal fibers with respect to the hand guard.

10. A device in accordance with claim 9, wherein the cross-sectional shape of the rail interrupts a circumference of the hand guard.

11. A device in accordance with claim 9, wherein the elongate hollow comprises an annular hollow and a channel connected thereto defined by the rail.

12. A device in accordance with claim 9, wherein the shell wall has a non-uniform thickness extending circumferentially.

13. A device in accordance with claim 9, further in combination with an accessory detachably coupled to the rail, the accessory being selected from the group consisting of: a hand grip with an axis transverse to the longitudinal axis of the barrel; a light source; a laser; a scope; a tactical scope; a sight; a night vision system; a bipod; a stand; a rail cover; a carrier or mount; a stock; a retractable stock; a foregrip; a sling; a sling mount or adaptor; a magazine pouch; a bayonet; a bayonet mount; a clamp or fixture or combinations thereof.

14. A device in accordance with claim 9, wherein the hand guard is formed along a proximal portion of the shell and the rail is formed along a distal portion of the shell.

15. A device in accordance with claim 9, wherein the hand guard has a plurality of spaced-apart ridges oriented transverse to the longitudinal axis on an outer surface of the shell.

16. A device in accordance with claim 9, wherein the hand guard has a convex curvature free of the rail.

17. A device in accordance with claim 9, wherein the hand guard and the rail are a monolithic structure with the shell wall being continuous and uninterrupted and seamless as the shell wall circumscribes the barrel.

18. A device in accordance with claim 9, wherein a fiber density at the rail is 60-70% greater than at the hand guard.

19. A device in accordance with claim 9, wherein the hand guard and the rail are integrally formed together at the same time as the shell wall.

* * * * *